United States Patent [19]

Larson

[11] 3,977,555

[45] Aug. 31, 1976

[54] PROTECTIVE SAFETY CAP FOR MEDICAMENT VIAL

[75] Inventor: Roger R. Larson, Champaign, Ill.

[73] Assignee: Pharmaco, Inc., Champaign, Ill.

[22] Filed: June 16, 1975

[21] Appl. No.: 587,681

Related U.S. Application Data

[63] Continuation-in-part of Ser. No. 467,802, May 7, 1974, Pat. No. 3,940,003.

[52] U.S. Cl. ..... 215/247; 128/272; 206/363

[51] Int. Cl.[2] ..... B65D 41/20; B65D 51/22; A61J 1/08

[58] Field of Search ..... 215/247, DIG. 3; 206/365, 363; 128/272

[56] References Cited

UNITED STATES PATENTS

| | | | |
|---|---|---|---|
| 2,644,452 | 7/1953 | Brown | 215/247 X |
| 3,336,924 | 8/1967 | Sarnoff et al. | 206/365 X |
| 3,823,840 | 7/1974 | Zackheim | 215/247 |
| 3,890,971 | 6/1975 | Leeson et al. | 206/365 X |

FOREIGN PATENTS OR APPLICATIONS

| | | | |
|---|---|---|---|
| 892,210 | 3/1962 | United Kingdom | 215/247 |

*Primary Examiner*—Leonard Summer
*Attorney, Agent, or Firm*—Clarence A. O'Brien; Harvey B. Jacobson

[57] ABSTRACT

A cap is provided for telescoping over the puncturable seal of a medicament vial and particularly a unit dose medicament vial. The cap includes a center outwardly projecting tubular extension including outer end circumferentially spaced inwardly projecting abutments. A needle structure including a generally cylindrical body is slidingly received within the tubular extension of the cap and includes a diametrically reduced sharpened tubular needle extension on its inner end opposing and for piercing the puncturable seal of the associated vial upon movement of the needle structure inwardly of the tubular extension or mounting portion of the cap. The exterior of the tubular needle extension, spaced from the terminal end thereof, includes a bulbous enlargement for abutting against and distention of the center portion of the puncturable seal of an associated vial in order to limit penetration of the needle extension through the seal and to stretch the central seal portion to insure its penetration by the sharpened inner end of the needle structure. A cover of tubular configuration and including a closed outer end has its inner end slightly telescoped over the outer terminal end of the tubular extension and encloses those portions of the body projecting outward of the extension, the cover being inwardly displaceable along the tubular extension for engagement with the outer end portion of the needle body to inwardly displace the latter for puncturing of the associated seal by means of the needle extension.

9 Claims, 8 Drawing Figures

PROTECTIVE SAFETY CAP FOR MEDICAMENT VIAL

BACKGROUND OF THE INVENTION

This application comprises a continuation-in-part of my co-pending U.S. application Ser. No. 467,802, for Safety Cap, filed May 7, 1974, issued as U.S. Pat. No. 3,740,013 on Feb. 24, 1976.

The safety cap of the instant invention constitutes an improvement over the safety cap in my above-mentioned co-pending application in that a protective cover is provided for completely enclosing those portions of the safety cap projecting outwardly of the tubular extension of the cap body, the root end portion of the diametrically reduced sharpened tubular needle extension portion thereof includes a bulbous enlargement for limiting penetration of the needle extension through the associate unit dose vial seal and affording positive outward displacement of the needle structure the proper amount subsequent to the seal being punctured and structure is provided whereby the telescoping outer cap will not bind upon its initial inward displacement and its subsequent outer displacement to effect removal thereof will not cause a partial vacuum to be formed within the hollow needle structure.

Otherwise, the safety cap of the instant invention is substantially the same as that disclosed in my above noted co-pending application.

BRIEF DESCRIPTION OF THE INVENTION

The safety cap of the instant invention is provided as a safety cover for the puncturable seal across the mouth of a medicament vial and includes a tapered needle portion which may be advanced through the puncturable seal of an associated vial and includes a bulbous enlargement on its exterior to limit penetration of the tapered needle portion through the seal. The tapered needle portion also includes internal portions thereof for wedgingly and sealingly seatingly receiving either the tip of a hypodermic needle or the tapering tubular tip extension of a conventional syringe barrel for the purpose of enabling liquid medicament from within the file to be withdrawn into the associated syringe barrel whether equipped with a hypodermic needle on its tubular tip extension or being without a hypodermic needle. The cap is of a configuration to be marketed on the associated medicament vial with an outer cover being provided for the cap for protection against contamination and use in initially inwardly displacing the tapered needle portion for puncturing the seal secured across the mouth of the associated medicament vial.

The primary object of this invention is to provide a coupling structure carried by the sealed end of a medicament vial and by which medicament may be withdrawn from the vial in a sterile manner either through the utilization of a syringe equipped with a needle or a syringe not provided with a needle but equipped with the usual tapering tubular tip extension on the barrel portion thereof provided to support a hypodermic needle.

Another object of this invention is to provide an apparatus which may be utilized in conjunction with different types of medicament vials but which is designed to primarily be used in conjunction with unit dose medicament vials.

Another import object of this invention is to provide a coupling structure including an inner tapered needle portion provided with means by which penetration of the needle portion through an associated medicament vial seal may be limited.

A further object of this invention is to provide an outer cover structure for telescopic engagement over and enclosing those portions of the shiftable needle structure exposed exteriorly of the outer end of the tubular extension of the cap portion of the cover.

A final object of this invention to be specifically enumerated herein is to provide a device in accordance with the preceding objects which will conform to conventional forms of manufacture, be of simple construction and easy to use.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
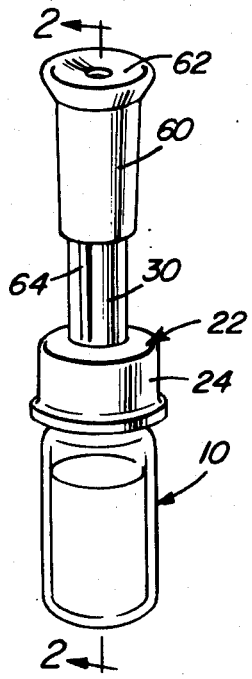
FIG. 1 is a perspective view of a unit dose vial of medicament closed by means of the usual rubber seal or plug supported in position by means of an aluminum ring and with the safety cap of the instant invention operatively secured over the plug and ring, the cover for the outer end portion of the cap being in the initial position thereof for shipment and storage prior to its use in causing the needle structure of the cover to be inwardly advanced for puncturing the rubber seal of the vial.

Referring now more specifically to the drawings, the numeral 10 generally designates a unit dose vial including a neck portion 12 closed at its outer end by means of a conventional rubber stopper or seal 14 held in position by means of a metal retaining ring 16 which is usually constructed of aluminum. The stopper or seal 14 includes a central portion 18 which is adapted to be pierced by a hypodermic needle advanced through the center opening 20 in the ring 16, which center opening is usually closed by means of an integral but removable portion of the ring 16. However, for use in conjunction with the instant invention to be described hereinafter, the opening 20 is left unobstructed.

The safety cap of the instant invention is referred to in general by the reference numeral 22 and includes a cap portion 24 equipped with circumferentially spaced and inwardly projecting lugs or abutments 26 for snap engagement over the retaining ring 16. The cap portion 24 includes an upper end wall 28 including an upwardly projecting tubular mounting portion 30 whose lower end opens downwardly through the end wall 28. The upper terminal end of the extension 30 includes circumferentially spaced inwardly projecting abutments 32 and a needle structure referred to in general by the reference numeral 34 is provided. The needle structure 34 includes a generally cylindrical body 36 provided with a small diameter downwardly tapering lower end extension 38 which is sharpened at its lower end as at 40. The extension 38 defines a stopper piercing needle for piercing the center portion 18 of the stopper or seal 14. The body 36 includes a tapering bore 41 extending therethrough and including a tapering continuation extending through the extension 38. The end of the bore 41 remote from the extension 38 includes a slightly tapering diametrically enlarged counter bore 42, the counter bore 42 tapering inwardly toward the bore 41 and the latter including an enlarged portion 43 in which a filter 43' of any suitable rating such as a 0.45, 2 or 5 micron rating may be seatingly received.

The cap portion 24 and tubular mounting portion 30 as well as the needle structure 34 are constructed of plastic material which has shape-retentive properties but which is slightly deformable. The body portion 36 of the needle structure 34 includes a large diameter lower end portion 44 which is slidably received within the tubular mounting portion 30 below the inwardly projecting abutments 32 and a small diameter cylindrical upper end portion 46 which is freely slidable in the upper end of the tubular mounting portion inwardly of the inner extremities of the abutments 32. The body 36 also includes a tapering central portion 48 whose minor diameter end terminates at a radially outwardly projecting shoulder 50 extending circumferentially about the outermost portion of the inner end portion 44 of the body 36 and the inner end of the outer end portion 46 terminates inwardly at a radially outwardly projecting and circumferentially extending shoulder 52 defined by the outer end of the central tapering portion 48 of the body 36. Still further, the outermost end of the outer end portion 46 terminates in a radially outwardly projecting and circumferentially extending shoulder 53 and the outer end of the counter bore 42 is chamfered as at 54.

In addition, the outer end of the tubular mounting portion 30 includes a circumferentially extending groove 56 in which an inwardly projecting and circumferentially extending rib 58 within the open inner end of an outer cap or cover 60 including a closed outer end 62 is removably seatable. Also, the exterior of the mounting portion 30 tapers toward the cap portion 24 and includes a single longitudinally extending outwardly projecting rib 64 which tapers in height toward the cap portion 24.

Figure 2:
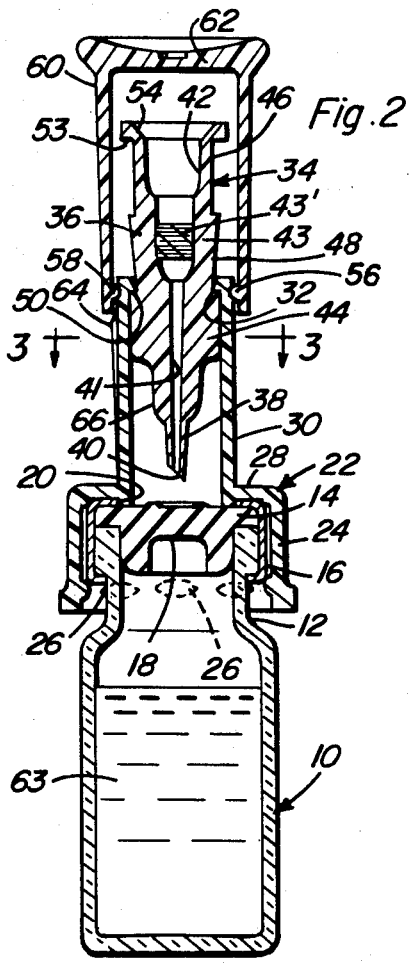
FIG. 2 is an enlarged vertical sectional view taken substantially upon the plane indicated by the section line 2—2 of FIG. 1.
Figure 4:
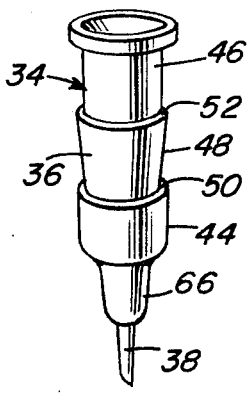
FIG. 4 is a perspective view of the needle structure of the safety cap.
Figure 3:
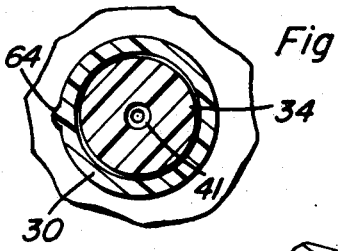
FIG. 3 is an enlarged horizontal sectional view taken substantially upon the plane indicated by the section line 3—3 of FIG. 2.

In operation, the needle structure 34 is initially positioned as illustrated in FIG. 2 of the drawings with the rib 58 of the outer cover 60 seated in the groove 56.

Figure 6:
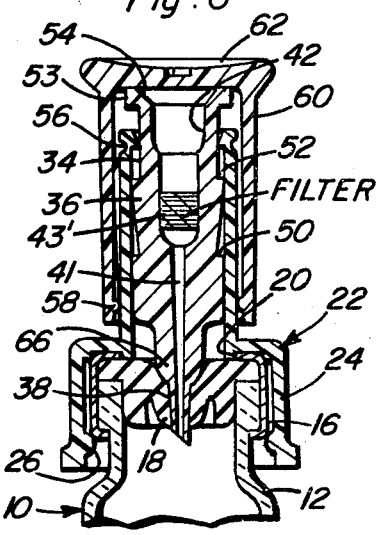
FIG. 6 is an enlarged fragmentary sectional view similar to the upper portion of FIG. 2 but with the outer cover and needle structure in inwardly displaced position.
Figure 5:
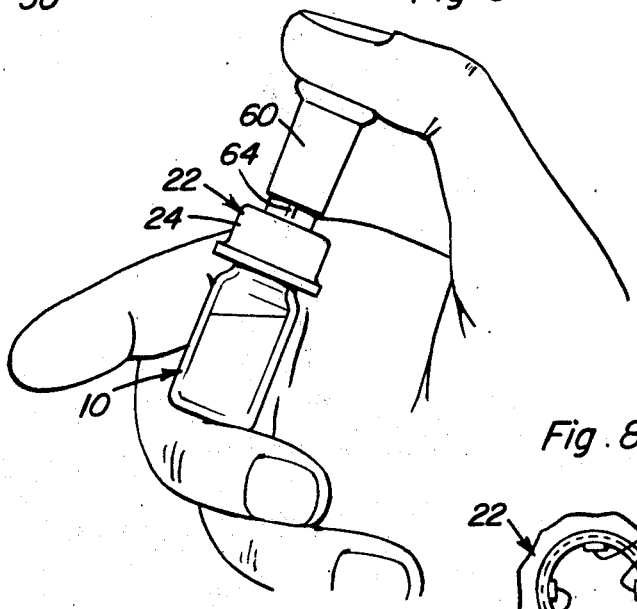
FIG. 5 is an elevational view of the safety cap equipped vial with the outer cover portion thereof being manually inwardly displaced so as to inwardly shift the needle structure of the cap for penetrating the seal of the vial.
Figure 7:
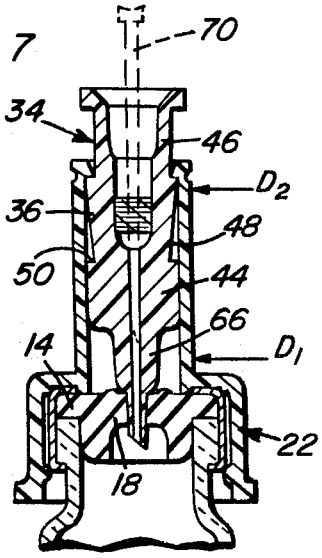
FIG. 7 is a fragmentary sectional view similar to FIG. 6 but with the outer cover removed and the needle structure outwardly displaced under the biasing influence of the resilient seal of the vial.
Figure 8:
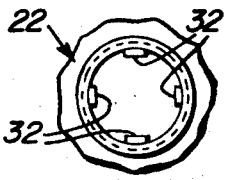
FIG. 8 is a fragmentary upper end view of the tubular extension of the cap with the needle structure and outer cover removed.

When it is desired to withdraw the liquid medicament 64 from within the vial 10 pressure is applied to the outer closed end 62 of the cover 60 so as to inwardly displace the cover 60 by axial pressure on the closed end 62 of the cover 60 causing the rib 58 to be unseated from the groove 56. Inasmuch as the rib 58 is unseated from the groove 56 in a snap action, the outer closed end 62 of the cover 60 moves sharply inwardly into engagement of the outer end of the needle structure 34 and the latter is inwardly displaced relative to the tubular extension or mounting portion 30 to the position thereof illustrated in FIG. 6 of the drawings with the needle defining extension 38 of the body 36 projecting through the central portion 18 of the stopper 14. Initial movement of the needle structure inwardly from the position thereof illustrated in FIG. 2 toward the position thereof illustrated in FIG. 6 is resisted by the tapering outer surfaces of the central portion 48 of the body 36 which cause the outer end of the tubular mounting portion or extension to expand. Accordingly, inward movement of the needle structure is met with increasing resistance to the inward pressure being applied to the needle structure 34. However, when the major diameter end portion of the central tapering portion 48 of the body 36 moves inwardly of the inwardly projecting abutments 32 and the pointed tip of the extension 38 has partially penetrated and downwardly deflected the central portion 18 of the stopper 14, further downward displacement of the needle structure 34 is not resisted by the inwardly projecting abutments 32 causing the outer end of the tubular mounting portion 30 to expand and final movement of the needle structure 34 to the position thereof illustrated in FIG. 6 with the lower or inner end of the inner end portion 44 of the needle structure 34 abutted against the stopper 14 is accomplished by a snap action so as to insure that the needle defining extension 38 will fully pierce the central portion 18 of the stopper 14. However, the bulbous outer surface enlargement 66 of the needle defining extension 38 engages the central portion 18 of the seal 14 in order to limit penetration of the needle defining extension 38 through the seal 14 whereby the central portion 18 is downwardly depressed to the position thereof illustrated in FIG. 6. Then, as the pierced and downwardly deflected central portion 18 of the seal 14 returns to its static position upon the release of downward manual pressure on the cover 60, the engagement of the shoulder 52 with the inwardly projecting abutments 32 positively prevents further outward movement of the needle structure 34 relative to the tubular mounting portion 30 of the cap 22. In this position of the needle structure 34, the sharpened lower end 40 of the needle structure 34 projects only slightly through the central portion 18 of the seal 14 and is wholly received within the inwardly opening cavity 68 formed on the inner surface of the seal 14.

After the needle structure 34 has been inwardly displaced to pierce the stopper or seal 14, the cover 60 is manually displaced outward relative to the tubular mounting portion 30 with a quick axial thrust on the cover 60 so that the rib 58 moves upward pass the groove 56 to enable full disengagement of the cover 60 from the tubular mounting portion 30. During upward movement of the cover 60, the rib 64 insures sufficient air space between the outer surfaces of the tubular extension 30 and the interior of the cover 60 to prevent a partial vacuum from being formed within the cover 60 and thus within the needle structure 34 projected through the seal 14.

After removal of the outer cover 60, a hypodermic needle 70 supported from a syringe (not shown) may be wedgingly and sealingly seated in the tapering bore 41 and the syringe and the vial 10 may be inverted with the vial 10 supported solely from the needle 70. Thereafter, the piston portion of the syringe may be pulled outward of the barrel portion thereof in order to extract the medicament 63 from within the vial 10. On the other hand, if it is desired to withdraw the medicament 63 from the vial 10 by means of a syringe which is not equipped with a hypodermic needle, the slightly tapering tubular tip extension of the syringe barrel may be wedgingly and sealingly seated in the counter bore 42 in the same manner as illustrated and described in my above noted co-pending application.

The taper of the bore 41 and the taper of the counter bore 42 in conjunction with the shape-retentive but slightly deformable plastic material of which the needle structure 34 is constructed enables either the needle 70 to be wedgingly seated in the bore 41 or the tip extension of an associated syringe to be wedgingly seated in the counter bore 42.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. For use in connection with a container having a puncturable resilient seal, a closure cap for support from said container in position with a mounting portion of said cap disposed outwardly of said seal and opening inwardly into the interior of said cap against the outer side of said seal, a tubular needle structure constructed of shape retentive but somewhat flexive and resilient material, said needle structure being supported from said mounting portion with one end thereof opposing the outer side of said seal and for movement of said structure toward and away from said seal, said one end of said needle structure including a pointed end portion for projecting through said seal, said pointed end portion tapering exteriorly toward the terminal end thereof, said pointed end portion, at a point spaced therealong from said terminal end, including a bulbous enlargement shiftable into the interior of said cap for engagement with and inwardly distending the area of said seal disposed about the portion thereof engaged by said pointed end portion and to thereby stretch said area upon final inward movement of said needle structure to insure the piercing of said pointed end through said seal while at the same time limiting penetration of said pointed end through said seal, whereby after a manual inward thrust on said needle structure to pierce said seal is released the resiliency of said seal may outwardly displace said needle structure, upon return of said area of said seal to its static position, to a use position with said pointed end portion projecting only a predetermined amount through said seal.

2. The combination of claim 1 wherein said needle structure is supported from said mounting portion for movement between a first position with said pointed end portion retracted away from the outer side of said seal and a second limit position with said seal distended by said bulbous portion and said pointed end portion projecting through the seal, said mounting portion and needle structure including coacting detent portions operative to positively prevent retractive movement of said needle structure from said second position toward said first position past a third position intermediate said first and second positions, said third position comprising said use position.

3. The combination of claim 1 wherein said tubular needle includes an interior bore portion tapering toward said one end of said needle structure and of a diameter adapted to wedgingly and sealingly seatingly receive the pointed end of a hypodermic needle therein.

4. The combination of claim 1 wherein said mounting portion of said cap and said needle structure include coacting portions progressively yieldingly resisting movement from said first position to a third position intermediate said first and second positions and then releasing said needle structure for free movement from said third position to said coacting position.

5. The combination of claim 4 wherein said coacting portions also includes means for positively preventing retractive movement of said needle structure from said second position toward said first position past said third position.

6. The combination of claim 1 wherein said mounting portion comprises a tubular member in which at least said pointed end portion of said needle structure is enclosed, and a tubular cover open at one end and closed at its other end, having its open end snugly removably telescoped over the outer end of said tubular member remote from said cap.

7. The combination of claim 6 wherein said tubular member tapers, slightly, on its exterior toward said cap.

8. The combination of claim 7 wherein said tubular member includes an exterior longitudinally extending rib over which said cover is telescoped and which defines air passages on both sides thereof between said tubular member and said cover.

9. In combination with an elongated mounting portion and a puncturable resilient seal extending across and supported at one end of said mounting portion with the outer side of said seal facing toward the other end of said mounting portion, a tubular needle structure constructed of shape retentive but somewhat flexive and resilient material, said needle structure being supported from said mounting portion with one end thereof opposing the outer side of said seal and for movement of said structure toward and away from said seal, said one end of said needle structure including a pointed end portion for projection through said seal, said pointed end portion tapering exteriorly toward the terminal end thereof, said pointed end portion, at a point spaced therealong from said terminal end, including a bulbous enlargement projectable from said mounting portion into engagement with and distention of the area of said seal disposed about the portion thereof engaged by said pointed end portion and to thereby stretch said area upon final inward movement of said needle structure to insure the piercing of said pointed end through said seal while at the same time limiting penetration of said pointed end through said seal whereby after a manual inward thrust on said needle structure to pierce said seal is released the resiliency of said seal may outwardly displace said needle structure, upon return of said area of said seal to its static position, to a use position with said pointed end portion projecting only a predetermined amount through said seal.

* * * * *